United States Patent [19]

Willums et al.

[11] 4,073,080

[45] Feb. 14, 1978

[54] METHOD OF UNDERWATER HYDRAULIC CONVEYING FOR OCEAN MINING AND THE LIKE

[76] Inventors: Jan-Olaf Willums, Massachusetts Institute of Technology, Bldg. 54-1418, Cambridge, Mass. 02139; Dieter Hody, Tannstr. 2, 8800 Thalwil, Switzerland

[21] Appl. No.: 458,414

[22] Filed: Apr. 5, 1974

Related U.S. Application Data

[63] Continuation of Ser. No. 294,304, Oct. 2, 1972, abandoned.

[51] Int. Cl.[2] ..... E02F 1/00; E02F 3/88

[52] U.S. Cl. ..... 37/195; 37/58; 37/DIG. 8; 302/14; 302/66; 417/53

[58] Field of Search ..... 417/54, 53; 302/14, 302/66; 37/195, DIG. 8, 58, 59, 72, 54, 55

[56] References Cited

U.S. PATENT DOCUMENTS

| | | | |
|---|---|---|---|
| 3,260,004 | 7/1966 | Brooks | 37/59 X |
| 3,438,142 | 4/1969 | Krutein | 37/195 |
| 3,783,535 | 1/1974 | Hanks | 37/55 |
| 3,783,536 | 1/1974 | Hanks | 37/55 |
| 3,815,267 | 6/1974 | Laarman | 37/195 X |

*Primary Examiner*—Clifford D. Crowder

*Attorney, Agent, or Firm*—Rines and Rines, Shapiro and Shapiro

[57] ABSTRACT

Minerals or other bodies are lifted hydraulically from a region below the surface of a free fluid medium, such as the ocean. An at least partly gas-filled chamber with an elongated conduit extending therefrom is at least partially submerged in the fluid medium so that the conduit extends to the region from which the bodies are to be lifted. The fluid level in the chamber is maintained sufficiently lower than that of the surrounding fluid medium, as by a suction pump exhausting into the medium, such that the fluid pressure corresponding to the difference between the fluid level in the chamber and the level of the medium is at least substantially equal to the sum of the frictional pressure drop of fluid through the conduit and the pressure drop due to the lifting of the bodies in the fluid medium through the conduit. The velocity of fluid flow through the conduit is maintained larger than the steady state sinking velocity of the bodies.

4 Claims, 3 Drawing Figures

METHOD OF UNDERWATER HYDRAULIC CONVEYING FOR OCEAN MINING AND THE LIKE

This is a continuation of application Ser. No. 294,304, filed Oct. 2, 1972, now abandoned.

The present invention is concerned with methods of and apparatus for underwater hydraulic conveying, as for ocean mining and the like, being more particularly concerned with a method of lifting fluid from depths that are greater than the effective maximum suction height of the employed pumping, and an apparatus using this method for such purposes as solid particle conveyance or transport and the like.

Various types of hydraulic and other conveying and recovery systems have been proposed and used over the years to mine minerals or other objects or otherwise recover material from under the sea or other bodies. Several typical pumping and related apparatus of this character are described, for example, in U.S. Pat. Nos. 2,992,497; 3,111,778; 3,143,816; 3,237,562; 3,248,812; 3,260,004; 3,305,950; 3,314,174; 3,343,877; 3,333,562; and in Ocean Industries, Gulf Publishing Company, March, 1969, pp. 66–8.

As has been well-known, however, the effective suction height of pumps, such as are described in said patents, is limited and determined by the surrounding gas pressure as well as the temperature of the water or other fluid to be lifted. Prior to the present invention, therefore, it has not been practically possible, under normal conditions at sea level, for example, to pump water by suction from a depth greater than about 10 meters or so.

In accordance with the present invention, on the other hand, this limitation problem has been obviated, in summary, by a method and apparatus wherein a fluid receiving and conveying device has an at least partially gas-filled chamber at least partly submerged within the fluid medium, and with the fluid level in the chamber maintained lower than that of the surrounding fluid medium. A conduit extends from the chamber to the region of the fluid medium from which fluid and bodies carried therewith are to be lifted. The pressure tending to force fluid through the conduit, due to the aforesaid fluid level difference, must be maintained greater than the sum of the pressure drops along the conduit, and the fluid velocity in the conduit must be greater than the steady state sinking velocity of the bodies. The chamber may be open to atmospheric pressure, but if a closed chamber is employed, the gas pressure must be maintained low enough to permit the fluid to flow into the chamber.

An object of the present invention, accordingly, is to provide a new and improved method of and apparatus for underwater hydraulic conveying, and for ocean mining and the like, as well as similar purposes, that shall not be subject to such pumping apparatus limitations and other difficulties.

A further object is to provide such a novel method and apparatus of more general utility, as well; other and further objects being explained hereinafter and more particularly delineated in the appended claims.

The invention will now be described with reference to the accompanying drawing,

FIG. 1 of which is a side elevation of an illustrative pumping station in the transport position on the ocean surface;

Figure 1:
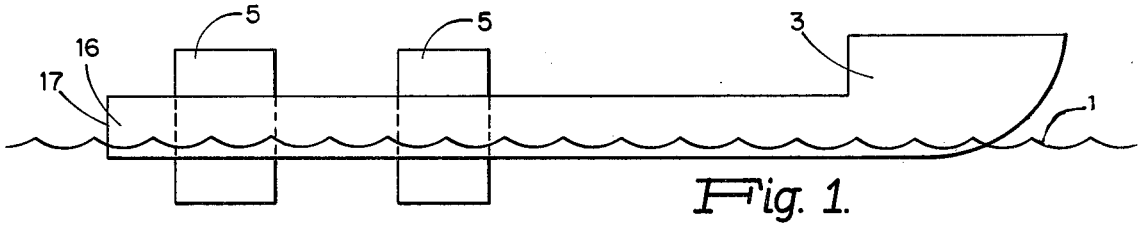
Figure 2:
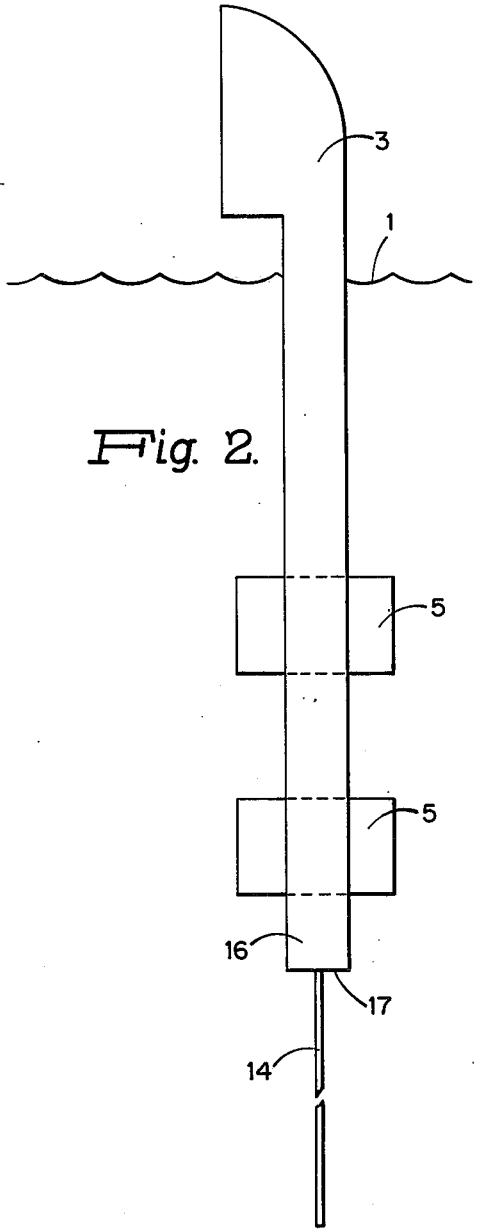
FIG. 2 is a similar view of the same in its operative or working position.

Referring to FIG. 1, the pumping station 3 is shown in vessel-like form adapted for horizontal transport along the ocean surface 1, and carrying ballast tanks or similar elements 5 for enabling the bringing of the station 3 from its transport position, by ballast flooding, to its substantially vertical or upright, elevated, working or operating position, FIG. 2, in which it is stable and practically unaffected by wave movement, winds and the like, because of its inherently low center of gravity and small cross-sectional area. Details of such mechanisms are known, as described, for example, in "Ocean Engineering", edited by J. F. Braktz, John Wiley & Sons, Inc., New York, 1968, and need not be further elaborated here.

Figure 3:
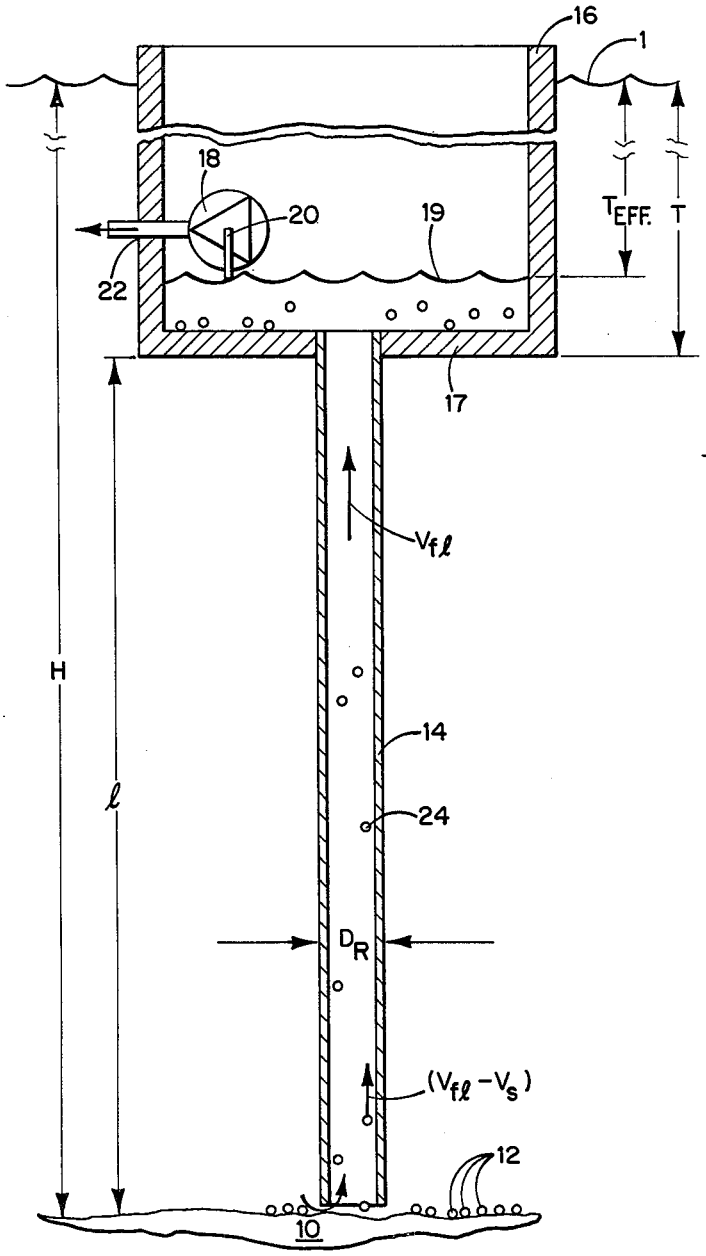
FIG. 3 is a fragmentary longitudinal section of the system shown in FIG. 2, upon an expanded scale, illustrating preferred details of the conveying or lifting of solid particles from the ocean bottom in accordance with the method underlying the present invention.

In FIG. 2, however, it will be observed that there has been extended from the lower terminal chamber portion 16 of the structure 3, a substantially smaller cross-section fluid-receiving-and-conveying conduit, transport tube or similar pipelike device 14 that, as more particularly shown in FIG. 3, communicates at its open lower end with the region of the ocean bottom 10 at which solid particles 12 or other material are to be transported upward, under suction later explained, along the device 14. The upper end of the conduit device 14 opens through the end wall 17 of the chamber terminal portion 16 of the station 3 and acts as an extension thereof to permit the fluid and particles 24 carried thereby during the ascending upward along the transport conduit device 14, to enter the larger chamber or cup-like portion 16, which acts as a hollow container preferably open to the gaseous atmosphere and its atmospheric pressure at its upper end. In the chamber 16, there is disposed a pump (or pumps) 18, such as a multi-stage centrifugal pump or the like, or pumps of the type described in said patents, the suction head 20 of which descends to the bottom wall 17 of the chamber 16, providing pressure heads at 22 to pump fluid 19 from within the chamber 16 out into the surrounding fluid.

The operation of the invention is based upon the following critical adjustments and conditions. Through the submerging under the ocean surface 1 of the chamber 16, or at least the terminal portion thereof, a moving force is created, proportional to the depth T of submergence, which forces the water from below, upward through the conveyance conduit 14; this operation continuing until the water level in the chamber 16 has reached the level of the surrounding ocean water, whereupon the water movement in the conduit 14 will cease. By maintaining a deliberate difference between the level of the ocean surface 1 and the fluid level 19 in the chamber 16, a continuous flow of water will be produced through the conduit 14. The level 19 is thus controlled by the atmospherically exposed pump (or pumps) 18, which (through the suction head 20 and with substantially zero suction height) pumps the incoming water back out into a submerged region of the ocean at 22, whereby the pressure at the pump equals the pressure at the exit in the surrounding water and is roughly equivalent to the submerging depth of the chamber 16.

As a result of the upward movement or transport of the water in the conduit 14, the solid particles 12 on the bottom 10, close to the open lower or inlet end of the conduit 14, will be drawn upward, also. The chamber 16, moreover, functions as a divider or separator of water and solid particles, with the latter removable to the surface by any well-known mechanical means, as later mentioned.

The physical aspects of the operation, including the critical adjustments and parameters required to produce the results of the invention will now be explained.

The transport of, for example, water and solids through the vertical conduit 14 causes a pressuredrop that is mainly composed of the following factors.

a. Frictional pressuredrop of flowing water in the conduit 14:

$$\Delta p_R = \lambda \cdot \frac{\rho_f}{2} \cdot V_{fl}^2 \cdot \frac{l}{D_R}, \quad (1)$$

where $\Delta P_R$ = frictional pressuredrop (Newtons/meter$^2$;i.e.N/m$^2$)

$\lambda$ = pressuredrop coefficient (friction factor)

$\rho_f$ = density of water (kg/m$^3$)

$V_{fl}$ = velocity of water in the conduit (meters/-second; i.e. m/s)

l = length of the conduit (m)

$D_R$ = conduit diameter (m);

b. Pressuredrop due to the lifting of solid particles from the ocean floor to the surface:

$$\Delta p_H = \frac{m_s^* g \cdot l}{F_R(V_{fl} - V_s)}, \quad (2)$$

where $\Delta p_H$ = pressuredrop due to the lifting of solid particles (N/m$^2$)

$m_s^*$ = solid particle mass flow (kg/s)

g = acceleration (m/s$^2$)

l = length of the conduit = lifting height (m)

$F_R$ = conduit cross section area (m$^2$)

$V_{fl}$ = velocity of water in the conduit (m/s)

$V_s$ = steady state sinking velocity of a solid particle in quiescent water (m/s).

The sum of the pressuredrops $\Delta P_R$ and $\Delta P_H$ is the total pressuredrop of the system, because the pressuredrops caused by the acceleration of water and particles from the velocity zero to the transport velocity are negligible in comparison to the sum $\Delta p_R + \Delta p_H$. The pressuredrop due to the friction of particles at the wall of the conduit and to the contact between particles is also negligible for the calculated particle concentration in the water.

To make the transport possible, another condition must be satisfied; namely, the water velocity in the conduit 14 must be larger than the steady state sinking velocity of the particles 24. The system can only work if the two conditions are satisfied that (1) a pressure within the system must be produced that is at least equal to the total pressuredrop $\Delta p_R + \Delta p_H$, and (2) $V_{fl}$ must be larger than $V_s$.

Submerging the chamber 16, open at its top, in a liquid, thus results in a bottom pressure proportional to the submerging depth T. In submerging the system, the pressure increases 1 atmosphere every 10 meters (1 atmosphere: a 10 m head of water). At the bottom of the open chamber 16, (upper end of the conduit 14), a pressure equivalent to the pressuredrop $\Delta p_R + \Delta p_H$ exists. At this point, water and solids will flow into the chamber 16, with the process continuing until the chamber is filled to the extent of satisfying the atmospheric conditions of the ocean surface. The transport process up the conduit 14 would then cease. In order to maintain a continuous process, water and solids must be removed permanently from the chamber 16. After the separation of liquid and solids near the bottom 17 of the chamber 16, the water is thus removed from the chamber against the pressure existing outside the chamber, as before mentioned.

Since the pump (or pumps) 18 is not submerged, but works at atmospheric conditions, no suction problems occur and it is always freely accessible. In addition, this involves only pumping of pure water without solids. The solids, moreover, can be removed by any well-known mechanical conveyance or transport.

The pump 18 functions in such a way that the water level 19 in the chamber 16 remains constant, and the pressure required for the flow is maintained. It is to be noted that the effective submerging depth is reduced by the water level in the chamber ($T_{EFF}$. In FIG. 3). At the end of the conduit 14 on the ocean floor 10, a special solids-pick-up-system may also be employed as described, for example, in said patents; and the whole recovery system may be moved in the horizontal plane over the bottom.

The following is a numerical example of a system employing the invention, wherein the indicated values are partly averages:

| | |
|---|---|
| length of the conduit 14 (approximately equal to the ocean depth H) | l = 5000 m |
| solid mass flow | $m_s^*$ = 27.8Kg/s |
| conduit diameter | $D_R$ = 0.8 m |
| water velocity in the pipe | $V_{fl}$ = 5.5 m/s |
| pressuredrop coefficient | $\lambda$ = 0.01 |
| density of water | $\rho_f$ = 1000 Kg/m$^3$ |
| acceleration | g = 9.81 m/s$^2$ |
| conduit cross section area | $F_R$ = 0.503 m$^2$ |
| steady state sinking velocity of a particle with 0.04 m diameter in water (spherical form) | $V_s$ = 1.5 m/s |

Since $\Delta p_R + \Delta p_H = \lambda \cdot \frac{\rho_f}{2} V_{fl}^2 \frac{l}{D_R} + \frac{m_s^* \cdot g \cdot l}{F_R(V_{fl} - V_s)}$,
the substitution of the specified values yields:
$\Delta p_R + \Delta p_H = 16.25 \times 10^5$ N/m$^2$.
Converting to hydraulic head in meters:
$T_{EFF.}$ = 165.5 m head of water.

To satisfy the conditions described above, slightly more than 165 m. of the recovery ship or station system should thus be submerged.

Thus the invention enables recovery from extreme depths, with practical-size pumping apparatus of much less effective maximum suction height. Very economical lifting of minerals or other bodies from the ocean body is thus attainable. More generically, this advantage may be beneficially used in other applications than ocean mining and the like, including, for example, other fluid systems as in chemical fluid processing. While the invention has been described in connection with the preferred atmosphere-exposed and pressured open chamber 16, moreover, the equivalent may sometimes be employed of maintaining a predetermined gas pressure (as in a fluid separation device connected to the chamber 16) which is low enough to permit the fluid to flow into chamber 16. In some applications, additionally, the fluid difference pressure may be attained by evaporation or similar techniques other than by pumping, thus to produce the required force for conveying the fluid upward along the conduit 14.

Further modifications will also occur to those skilled in this art, and all such are considered to fall within the spirit and scope of the invention as defined in the appended claims.

What is claimed is:

1. A method of lifting fluid and bodies carried therewith from a region below the surface of a free fluid medium, that comprises providing an at least partly gas-filled chamber with an elongated conduit commencing with an outlet to said chamber at a bottom wall of said chamber and then extending away therefrom externally of the chamber, at least partially submerging the chamber in the fluid medium to a depth of the order of hundreds of meters and extending the conduit downwardly from said bottom wall of the order of thousands of meters to said region below the surface of said medium, whereby fluid carrying said bodies tends to move from said region through said conduit into said chamber, leaving said conduit at said bottom wall and rising in said chamber above said outlet, providing a pump in said chamber adjacent to the bottom wall thereof and operating said pump to pump fluid from said chamber into the fluid medium surrounding said chamber and at a rate to maintain the uppermost fluid level in said chamber sufficiently lower than that of the surrounding fluid medium such that the fluid pressure corresponding to the difference between said levels is at least as great as the sum of the frictional pressure drop of fluid through said conduit and the pressure drop due to the lifting of said bodies in the fluid medium through said conduit, maintaining the velocity of fluid flow through said conduit larger than the steady state sinking velocity of said bodies, and maintaining the gas pressure in said chamber low enough to permit the fluid from said conduit to flow into said chamber.

2. A method as claimed in claim 1 and in which the uppermost fluid level is maintained by pumping fluid upwardly from the vicinity of the bottom of said chamber into the surrounding fluid medium above the bottom of said chamber.

3. A method as claimed in claim 1 and in which the bodies are separated from the fluid in said chamber.

4. A method as claimed in claim 1 and in which the fluid level in said chamber is maintained substantially constant.

* * * * *